United States Patent [19]

Wade, III

[11] Patent Number: 4,616,418

[45] Date of Patent: Oct. 14, 1986

[54] BEAM COMPASS HAVING CHANGEABLE PARTS

[76] Inventor: Charles R. Wade, III, P.O. Box 297, Dawsonville, Ga. 30534

[21] Appl. No.: 749,730

[22] Filed: Jun. 28, 1985

[51] Int. Cl.[4] ..... B43L 9/00

[52] U.S. Cl. ..... 33/27.01; 33/27.03

[58] Field of Search ..... 33/27 C, 27 R, 27 B

[56] References Cited

U.S. PATENT DOCUMENTS

| | | | |
|---|---|---|---|
| 1,005,827 | 10/1911 | Gombart | 33/27 C |
| 1,166,889 | 1/1916 | Crutchfield | 33/27 C |
| 2,046,508 | 7/1936 | Friess | 33/27 C |
| 2,062,157 | 11/1936 | Bensimol | 33/27 C |
| 2,419,752 | 4/1947 | Zumbuhl | 33/27 C |
| 2,505,236 | 4/1950 | Dooley | 33/27 C |
| 2,621,412 | 12/1952 | Slusher, Jr. | 33/27 C |
| 2,737,720 | 3/1956 | Kaser | 33/27 C |

*Primary Examiner*—Willis Little
*Attorney, Agent, or Firm*—James B. Middleton

[57] ABSTRACT

A beam compass having exchangeable parts for drawing on a variety of surfaces. The central post of the compass is moveable along the beam to vary the radius, and the central post has a rotatable sleeve with a knob at the upper end of the post. One may hold the sleeve and rotate the knob to draw a circle. The marker carrier at the end of the beam can receive a large marker such as a large felt-tip pen, or a chuck can be inserted, the chuck receiving smaller diameter markers such as crayons or chalk. A knob on the upper end of the chuck can be used to manipulate the compass if desired. Also, the central post terminates in the center holding device to be placed at the center of the circle, and this device is exchangeable to fit the particular surface. In the event the center holding device is a needle, a slidable guard selectively covers the needle for safety.

8 Claims, 7 Drawing Figures

Fig. 3
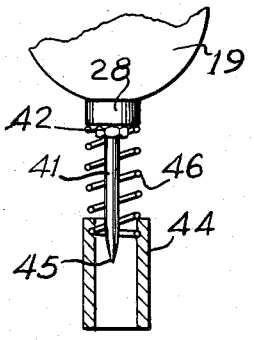
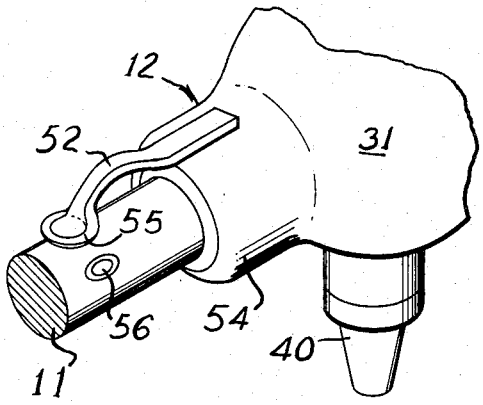
Fig. 5
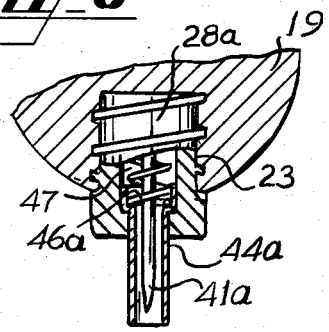
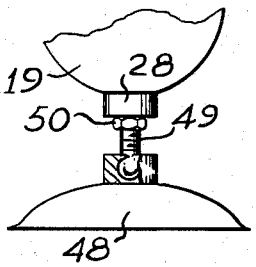
Fig. 4
Fig. 3A
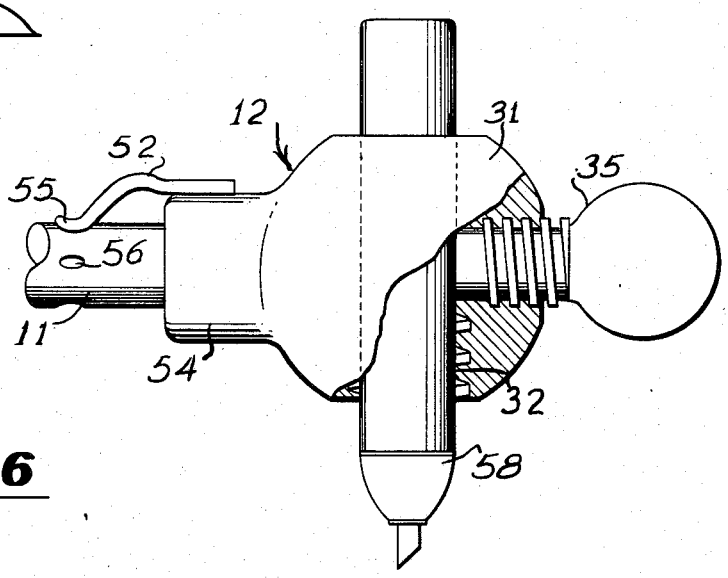
Fig. 6

BEAM COMPASS HAVING CHANGEABLE PARTS

INFORMATION DISCLOSURE STATEMENT

Beam compasses have long been known in the art, and there are numerous forms of compass for various specific purposes. There has long been a particular problem in providing a compass for chalkboards and the like, especially since the usual point, or needle, for placement at the center of the circle is not satisfactory for a hard surface such as a chalkboard. Also, it has been difficult to provide a compass useable on vertical surfaces whereby the compass can draw large enough circles for use in demonstrations. When compasses have been provided that have sufficient reach for the large circles, the apparatus has generally been very difficult to manipulate.

The prior art has provided a suction cup or the like for placing at the center, such an arrangement being shown in the U.S. Pat. Nos. 2,062,157 and 3,111,761. Both these patents disclose beam compasses having a rubber cup at the center, and a chalk holding device carried by a beam, but neither of these devices is arranged for easy manipulation, or for versatility in center points and marking devices. U.S. Pat. No. 951,255 discloses an arrangement that is designed for easy manipulation, but this device is quite complex, and cannot provide the versatility needed.

SUMMARY OF THE INVENTION

This invention relates generally to compasses, and is more particularly concerned with a highly versatile beam compass whereby parts are exchangeable for versatility in use.

The present invention provides a central member having a center holding means carried at one end thereof, with a beam generally perpendicular to the central member and moveable with respect thereto. One end of the beam mounts a marker carrier. The central member is arranged so the center holding means can be exchanged to be appropriate for the surface involved. The central member further includes a rotatable sleeve to allow the central member to be held while the beam is rotated.

The marker carrier mounted on the beam is designed for supporting various marking devices, and may include a chuck for carrying one or more marking devices, one end of the chuck carrying a knob to aid in manipulation of the marking device.

The beam compass of the present invention is such that it may be constructed as a highly accurate compass for use by various professionals, as a medium quality compass for use by the general public, or as a large and colorful compass for use by children, the compass being highly versatile in all embodiments.

BRIEF DESCRIPTION OF THE DRAWINGS

These and other features and advantages of the present invention will become apparent from consideration of the following specification when taken in conjunction with the accompanying drawings in which:

FIG. 3 is a fragmentary detail showing a modified form of the center holding means;

FIG. 3A is a view similar to FIG. 3 showing another modified form of center holding means;

FIG. 4 is a view similar to FIG. 3 showing another modification of the center holding means;

FIG. 5 is a fragmentary perspective view illustrating a detail of construction; and, FIG. 6 is a front elevational view, partially in cross-section, showing the marker carrier.

DETAILED DESCRIPTION OF THE EMBODIMENTS

Figure 1:
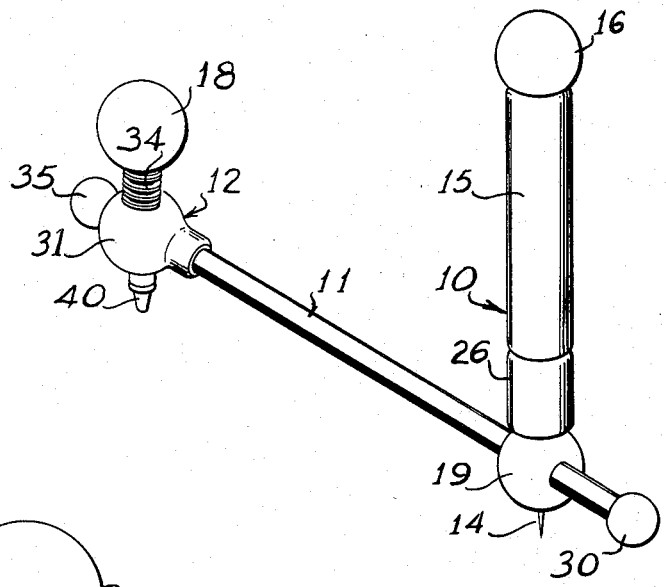
FIG. 1 is a perspective view showing a beam compass made in accordance with the present invention.

Referring now more particularly to the drawings, and to those embodiments of the invention here presented by way of illustration, in FIG. 1 it will be seen that the compass includes a central post generally designated at 10, a beam generally designated at 11 disposed perpendicularly to the central post 10, and a marker carrier generally designated at 12 mounted at one end of the beam 11.

The central post 10 includes the center holding means here shown as a point, or needle, 14 extending vertically downwardly along the vertical centerline of the central post 10. The center holding means 14 is of course to be placed at the center of a circle to be drawn while a marking device in the marker carrier 12 scribes a circle. Thus, the central post 10 also includes a sleeve 15 that can be held while the beam 11 is rotated. It will be readily noticed from FIG. 1 that the beam 11 may be rotated either by rotating the knob 16 at the upper end of the central post 10, or by manipulating the knob 18 on the marker carrier 12.

Figure 2:
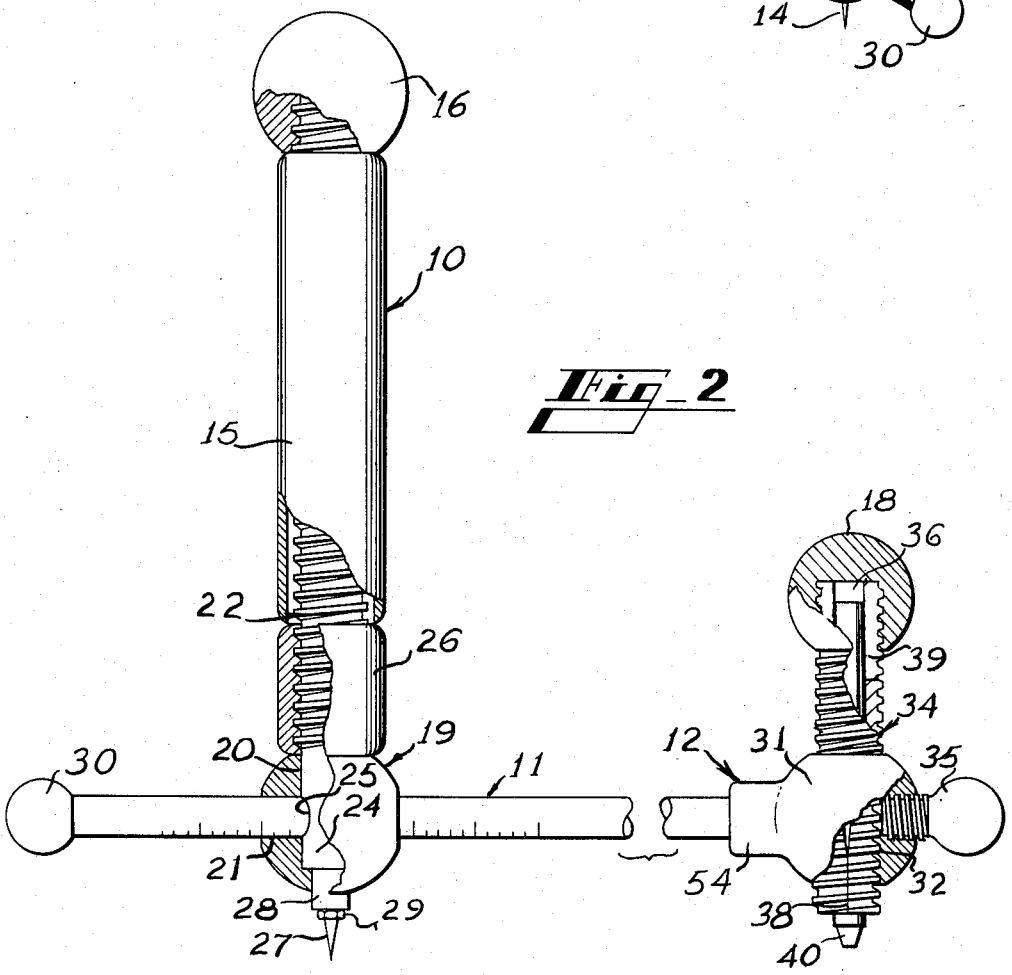
FIG. 2 is a front elevational view of the compass shown in FIG. 1, portions thereof being broken away to show the construction.

Attention is next directed to FIG. 2 of the drawings for a better understanding of the construction of the compass of the present invention. It will here be seen that the central post 10 includes a connector 19 having a vertically extending bore 20. Intersecting the vertically extending bore 20 is a horizontal hole 21 extending completely through the connector 19.

Received within the bore 20 is a rod 22. The rod 22 includes a lower end 24 received within the bore 20 and having a horizontally extending diametrical hole 25 therethrough. The upper portion of the rod 22 is externally threaded, and receives an internally threaded nut 26, shown positioned against the connector 19.

With the above described construction, it will be understood that the rod 22 is inserted into the connector 19, and the hole 25 is aligned with the hole 21 through the connector 19. The beam 11 is then passed through the connector 19 and through the hole 25 in the rod 22. The nut 26 can be threaded onto the rod 22; and, when the nut 26 is tightened firmly against the connector 19, the end 24 of the rod 22 will move upwardly to clamp the beam 11 in place. On the other hand, when the nut 26 is released, the beam 11 will be released and can be slid back and forth through the connector 19. Indicia may be placed on the beam as shown in FIG. 2 for direct setting of the desired radius.

The rod 22 is threaded throughout its length as here shown, and the knob 16 can be threadedly received on the uppermost end of the rod 22, the sleeve 15 being slipped over the rod before installation of the knob 16.

The connector 19 includes a downwardly extending, internally threaded member 28. The needle 27 of the center holding means 14 has external threads, and includes a stop nut 29. It will therefore be understood that the needle 27 can be rotated and removed from the device 28 so the center holding means 14 can be easily exchanged.

As shown in FIG. 2 of the drawings, the lefthand end of the beam 11 includes a knob 30. The knob 30 can be threadedly received on the extreme end of the beam 11 and simply acts as a stop, and may improve the aesthetic appeal of the compass.

The opposite end of the beam 11 mounts the marker carrier 12 which includes a connector 31. The connector 31 includes a boss 54 which may be threadedly received on the end of the beam 11. The connector 31 then includes a vertically extending, internally threaded hole 32 adapted to receive, for example, an externally threaded chuck 34. A set screw 35 bears against the chuck 34 to hold it in place.

It will be well understood by those skilled in the art that numerous forms of scribes or marking devices can be received in the connecting means 31. As illustrated in FIG. 2 of the drawings, the chuck 34 includes simply an externally threaded member having axial bores 36 therethrough. The chuck 34 is then split diametrically as at 38 and 39 to allow the sides of the bores to be expanded and contracted. It is contemplated that one end of the chuck 34 will be provided with a bore of one size, and the opposite end of the chuck will have a bore of a different size. With this arrangement, two different types of marking devices, or scribes, can be used in the single chuck simply by inverting the chuck. As here shown, there ia a conventional crayon 40 shown in position for writing, and the opposite end of the chuck 34 is of an appropriate size to recieve a piece of chalk. As previously mentioned, the knob 18 is threadedly received on the upper end of the chuck 34 for both aesthetic reasons and for easy manipulation of the device.

Looking at FIG. 3 of the drawings, the center holding means includes an externally threaded post 41 with a stop nut 42. The device shown in FIG. 3 is different from the device shown in FIG. 2 in that the pointed rod 41 includes a retractable shield 44. The shield 44 includes simply a cylindrical member around the point 45, and held in position by a spring 46. Thus, when the compass is placed against a surface, the shield 44 will engage the surface. With further pressure, the spring 46 will be compressed and the point 45 will engage the surface to hold the compass in position.

FIG. 3A illustrates another construction for providing a retractable shield for the needle. In FIG. 3A the connector 19 is provided with a threaded opening 23 which receives a threaded plug **28*a*. The plug 28*a*, then, has a bore 47 which contains the slidable shield 44*a*. A spring 46*a* urges the shield 44*a* to its lowermost position surrounding the point of the needle 41*a***.

It will be noted that the shield **44*a* and the bore 47 have complementary shoulders which limit the downward movement of the shield 44*a***.

FIG. 4 shows another modification of the center holding means. The center holding device comprises a suction cup 48 carried at the end of a threaded shaft 49 with a stop nut 50. The suction cup 48 is rotatable with respect to the shaft 49 so the suction cup can remain in place on the surface while the compass rotates to draw a circle. The arrangement shown in FIG. 4 is especially adapted for use on such surfaces as chalkboards and the like wherein a needle, such as those shown in FIGS. 1–3A, would damage the surface. It will also be understood by those skilled in the art that the center holding means disclosed here are by way of illustration only, and it will be equally well understood that rubber tips and numerous other arrangements can be substituted without departing form the scope of the present invention. It will further be seen that the shaft 49 can be mounted in a plug such as the plug **28*a*** for allowing center holding means to be easily interchanged.

Those skilled in the art will understand that some marking means operate better if angled slightly with respect to the surface, generally angled in the direction of motion. To provide for such angling, the connector 31 may be rotatable on the beam 11. FIG. 5 shows one means for allowing selective angling of the marking device by angling the connector 31. In FIG. 5 it will be seen that there is a spring member 52 carried on the extending boss 54 of the connector 31. The spring 52 is arranged to exert a force against the beam 11 with the generally spherical tip 55 entering recesses in the beam 11 such as the recesses 56. It will therefore be understood that there is a detent arrangement whereby the connector 31 can be placed at a selected position, and the spring force holding the spherical member 55 within the notch 56 will retain the connector 31 in the selected position. Of course, with sufficient rotating force on the connector 31, the spring 52 will allow the spherical member 55 to ride out of one notch 56 and into another for changing the angle of the writing device.

FIG. 6 also shows the detent arrangement, and illustrates another use of the threaded hole 32. It will be seen in FIG. 6 that a felt tip marker 58 is shown received through the hole 32. As before, the set screw 35 can hold the marker 58 in position.

From the foregoing description, operation of the device should be understandable. As shown, the entire device can be disassembled very easily, and the particular features desired can be utilized. Thus, all portions of the compass are adjustable to meet the specific needs. More particularly, the center holding means 14 can be exchanged to suit any surface on which one may be working, or it may be varied to be safe for a small child or highly accurate for a skilled professional.

Looking especially at FIG. 2 of the drawings, it will be noticed that the chuck 34 can be adjusted vertically with respect to the beam 11 so the operating tip of the, for example, crayon 40 wil be at the right level for the post 27. Also, the post 27 can be screwed in or out by varying the position of the stop nut 29 so there is considerable latitude in adjusting the center holding means 14 and the marking device 40 with respect to the beam 11.

It is contemplated that the compass of the present invention can be made of metals, plastics and the like to provide a highly accurate, professional device, and of course the size and shape of the knobs 16 and 18 and connectors 19 and 31 can be varied widely for both functional use and appearance. It is equally well contemplated that the compass of the present invention can be made quite large, perhaps of plastic or wood, and may be brightly colored for appeal to children. Because of the construction, whereby the compass includes a plurality of knobs and the entire compass can be disassembled simply by unscrewing various parts, the compass could become an assembly toy for a relativlely small child, the toy being also useful in drawing to teach various forms of manual dexterity.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention and defined in the appended claims.

I claim:

1. A beam compass comprising a central post for placement at the center of a circle to be drawn, said central post including center holding means for engagement with the surface on which said circle is to be drawn, a beam extending from said central post perpendicular to said central post and parallel to said surface on which said circle is to be drawn, and a marker carrier mounted on one end of said beam, said marker carrier having a marking means for drawing said circle on said surface, said central post including a connector for selectively holding said beam relative to said central post, a rod extending from said connector along the centerline of said central post, and a sleeve rotatably received over said rod, the arrangement being such that said sleeve can be held while said beam with said marker carrier is rotated with said center holding means as the center, said central post further including a knob mounted on the extending end of said rod and serving as a stop for retaining said sleeve on said rod, said knob being fixed to said rod such that said knob may be rotated to cause rotation of said beam, said connector defining a bore for receiving the inner end of said rod, said connector and said rod defining holes therethrough perpendicular to said bore for slidably receiving said beam, and means for urging said rod upwardly to clamp said beam in a selected position with respect to said connector.

2. A beam compass comprising a central post for placement at the center of a circle to be drawn, said central post including center holding means for engagement with the surface on which said circle is to be drawn, a beam extending from said central post perpendicular to said central post and parallel to said surface on which said circle is to be drawn, and a marker carrier mounted on one end of said beam, said marker carrier having a marking means for drawing said circle on said surface, said central post including a connector for selectively holding said beam relative to said central post, a rod extending from said connector along the centerline of said central post, and a sleeve rotatably received over said rod, the arrangement being such that said sleeve can be held while said beam with said marker carrier is rotated with said center holding means as the center, said central post further including a knob mounted on the extending end of said rod and serving as a stop for retaining said sleeve on said rod, said knob being fixed to said rod such that said knob may be rotated to cause rotation of said beam, said marker carrier including a second connector carried by said beam, said second connector defining a bore vertically therethrough for receiving said marking device, and a set screw communicating with said bore, said bore through said second connector having threads therein, said compass further including a chuck for receiving said marking device, and external threads on said chuck engageable with said threads in said bore, said set screw being engageable with said chuck.

3. A beam compass comprising a central post for placement at the center of a circle to be drawn, said central post including center holding means for engagement with the surface on which said circle is to be drawn, a beam extending from said central post perpendicular to said central post and parallel to said surface on which said circle is to be drawn, and a marker carrier mounted on one end of said beam, said marker carrier having a marking means for drawing said circle on said surface, said marker carrier including a connector fixed to one end of said beam, said connector defining a bore vertically extending therethrough for receiving said marking means, and means for holding said marking means in place within said bore, said marking means being selectively movable along said bore for placing the tip of said marking means a preselected distance from said beam, said marker carrier further including a chuck, said bore through said connector having threads therein, said chuck having external threads engageable with said threads in said bore.

4. A beam compass as claimed in claim 3, said chuck having a first hole in one end thereof and a second hole in the opposite end thereof, said first hole being of a first diameter for receiving a marking device having approximately said first diameter, said second hole being of a second diameter for receiving a marking device having approximately said second diameter, and a knob threadedly engageable with the upper end of said chuck.

5. A beam compass as claimed in claim 4, said central post including a sleeve rotatable with respect to said beam, and a knob on the upper end of said central post.

6. A beam compass as claimed in claim 5, said connector being rotatably fixed to said beam, and further including detent means for selectively holding said connector in a selected orientation with respect to said beam.

7. A beam compass comprising a central post for placement at the center of a circle to be drawn, said central post including center holding means for engagement with the surface on which said circle is to be drawn, a beam exending from said central post perpendicular to said central post and parallel to said surface on which said circle is to be drawn, and a marker carrier mounted on one end of said beam, said marker carrier having a marking means for drawing said circle on said surface, said central post including a connector for selectively holding said beam relative to said central post, said center holding means including a pointed rod mounted on said centerline of said central post, said connector including receiving means for receiving said pointed rod, a cylindrical shield concentric with said pointed rod and selectively covering the point of said pointed rod, and spring means for urging said shield into point covering position, the arrangement being such that said shield normally covers said point and said shield is movable away from said point when said center holding means engages said surface on which said circle is to be drawn.

8. A beam compass as claimed in claim 7, said center holding means including a plug receivable within said connector, said plug defining a central bore, said pointed rod being carried generally axially of said bore, said shield being slidable within said bore and surrounding said pointed rod, said spring means urging said shield downwardly to surround the point of said pointed rod.

* * * * *